US005372845A

United States Patent [19]

Rangaswamy et al.

[11] Patent Number: 5,372,845

[45] Date of Patent: Dec. 13, 1994

[54] METHOD FOR PREPARING BINDER-FREE CLAD POWDERS

[75] Inventors: Subramanian Rangaswamy, Rochester Hills; Robert A. Miller, Oak Park, both of Mich.

[73] Assignee: Sulzer Plasma Technik, Inc., Troy, Mich.

[21] Appl. No.: 847,554

[22] Filed: Mar. 6, 1992

[51] Int. Cl.[5] ..... B05D 7/00

[52] U.S. Cl. ..... 427/216; 427/453; 427/456; 427/242

[58] Field of Search ..... 75/255; 427/216, 217, 427/456, 242, 453

[56] References Cited

U.S. PATENT DOCUMENTS

| | | | |
|---|---|---|---|
| 3,591,362 | 7/1971 | Benjamin | 75/255 |
| 4,101,713 | 7/1978 | Hirsch et al. | 427/456 |
| 4,799,955 | 1/1989 | McClellan | 75/255 |
| 4,818,567 | 4/1989 | Kemp, Jr. et al. | 427/216 |
| 4,915,987 | 4/1990 | Nara et al. | 427/242 |
| 5,070,591 | 12/1991 | Quick et al. | 75/342 |

FOREIGN PATENT DOCUMENTS 1041620 9/1966 United Kingdom .

*Primary Examiner*—Shrive Beck
*Assistant Examiner*—Katherine A. Bareford
*Attorney, Agent, or Firm*—Dykema Gossett

[57] ABSTRACT

A method of forming binderless clad powders using a high energy ball mill, preferably an attritor-type ball mill, is described. The binderless clad powders are formed by combining and processing a core material powder and a coating material (either a powder with significantly smaller particle size than the core material powder or a brittle material that will quickly form a powder with significantly smaller particle size than the core material powder) in a high energy ball mill for a relatively short time (generally less than one hour The processing time employed is such that the particle size of the core material powder is not significantly reduced but that the clad powders are formed. At least one of the two materials (i.e., core forming material or coating forming material) must be deformable within the high energy ball mill. Such binderless clad powders are suitable for use as thermal spray powders and which can be thermally sprayed to form coatings on a various substrates.

11 Claims, 3 Drawing Sheets

100μm

50μm

METHOD FOR PREPARING BINDER-FREE CLAD POWDERS

TECHNICAL FIELD

The present invention relates generally to thermal spray powders and thermal spray processes. More specifically, the present invention provides an improved method utilizing a high energy ball mill for preparing binder-free clad powders which are especially useful as thermal spray powders. The binder-free clad powders of the present invention consist of a core material coated or partially coated with a second material. Such powders are useful for preparing thermal spray coatings.

BACKGROUND OF THE INVENTION

Composite coatings have been made by a number of methods which are referred to generally as thermal spray processes. Thermal spray processes are used in numerous industries to form coatings on metallic and non-metallic substrates. The relative sophistication of these processes and of the coatings so formed has increased rapidly in recent years resulting in the fabrication of high-tech composite materials. In essence, discrete particles are heated (often melted or softened) and accelerated in a high energy stream. In this state, the particles impact a target. Under proper conditions, high quality coatings are formed. It will be appreciated by those skilled in the art that while a number of parameters dictate the composition and microstructure of the final coating, the nature of the particles which are sprayed determines in large part the characteristics of the coating. There has been, therefore, a continuing interest in developing new thermal spray powders and methods for making such powders.

Thermal spray powders are used in both plasma spraying and combustion flame spray processes. Plasma spraying employs a high velocity gas plasma to spray a material. The plasma is formed by flowing a plasma forming gas through an electric arc which partially ionizes the gas into a plasma stream. The recombination of ions and electrons then creates an extremely hot, high velocity gas jet exiting the plasma gun nozzle. Particles are injected into the gas either inside or outside the gun. The particles which are sprayed typically range in particle size from about 5 to 150 microns. The temperature of the jet may reach 10,000° C. and the sprayed particles may attain supersonic velocity. In combustion flame spraying, a fuel gas and an oxidant gas are flowed through a nozzle and then ignited to produce a diffusion flame. The material to be sprayed is flowed into the flame where it is heated and propelled toward a substrate. The powder may be injected axially or externally into the flame in a carrier gas. Some flame spray guns utilize a gravity feed mechanism to introduce the powder into the flame front.

A number of prior art thermal spray powders and methods of forming thermal spray powders are known in the art. As stated, the characteristics of the powder are critical in determining the properties of the final coating. Moreover, powder properties also dictate whether a selected powder can be successfully sprayed in a particular thermal spray application. Although it is known to form composite materials by simultaneously spraying two or more materials, at times using two distinct thermal spray guns or multiple injectors, the use of composite powders is preferred. Thus, in a number of applications, composite coatings are formed by thermal spraying a powder which consists of individual composite particles.

Composite thermal spray powders suitable for thermal spray techniques may be either binderless or binder-containing powders. And such powders may consist of homogeneous powder particles wherein the two discrete materials are uniformly interdispersed (e.g., particles of one component uniformly and homogeneously dispersed in a matrix of the other component) or of clad particles (e.g., one component forming the core and the second component forming a surface coating on the core particle). Generally, homogeneous particles have been prepared in both the binder-containing and binderless forms. The clad particles formed with binders are also readily available. Binderless clad particles are generally not readily available. Currently only a few such binderless clad powders, which are prepared using chemical deposition techniques, are available.

Spray drying techniques have been used to prepare homogeneous, binder-containing particles. In this method, a slurry of two discrete materials suspended in a binder solution is sprayed into a heated chamber. The resultant dried agglomerated particles which contain binder are then classified by size. If the particle size of the two materials are about the same, the resultant powder is generally a homogeneous powder wherein the two discrete materials are completely and intimately interdispersed throughout the powdered product. Or if one of the particles is much smaller than the other, clad particles can be formed where the smaller particle forms a coating on at least some of the larger particles. In either case, the agglomerated powder is then sprayed utilizing one of the aforementioned thermal spray methods to form a composite coating.

U.S. Pat. No. 3,655,425 provides a method for producing a clad powder using a binder. In this patent, the cladding is accomplished by mixing the metal core particles and the ceramic cladding particles with a resinous binder in a suitable solvent. The solvent is then removed and any agglomerates formed between the core particles are broken up. The resulting particles consist of a metal core with ceramic particles attached to the surface through the binder material. The clad powder can be used to form a composite coating using thermal spray methods.

Binder materials may degrade coating performance. For example, it is known that thermal-induced changes may occur during thermal spraying at the interface of two different materials of a composite particle. As the materials chemically react or form an alloy layer, the capacity of the sprayed powder to form high performance coatings having excellent adhesive properties may be enhanced. The ability of the materials to interact in this manner, however, is inhibited by the presence of a layer of binder which physically separates the discrete materials. In other words, a binder may form a barrier to material interaction thus interfering with the fabrication of coatings having desired characteristics. Although organic binders may be employed which are vaporized or oxidized during the thermal spray process, vaporization or oxidation may not be rapid enough or complete. This is particularly true where plasma spraying is conducted under vacuum conditions or in an inert atmosphere, since conventional composite powders are formed with organic binders which generally do not fully vaporize or oxidize under these conditions.

Clad powders without added binders have been prepared using chemical deposition techniques whereby the coating is deposited from the appropriate deposition solution directly upon the seed or core particles. The preparation of such clad powders is described in V. N. Mackiw, W. C. Lin, and W. Kunda, "Reduction of Nickel by Hydrogen from Ammoniacal Nickel Sulphate Solutions," J. Metals 786 (1957). The selection of the components of such clad powders is very limited due to the limited availability of the required chemical deposition solutions and the requirement that the deposition process itself be carefully controlled. Such processes are generally very slow, thereby significantly increasing the cost of the clad powders.

Processes are also known for producing binderless powders of homogeneous particles where the components are uniformly dispersed throughout the powder (i.e., binderless non-clad particles). These processes include high energy ball mills, such as attritors, whereby the components are milled together for extended periods of time to form homogeneous powders. Generally, the metal powder and the powder component to be dispersed in the metal matrix are introduced into an attritor grinding mill which is a high energy driven ball mill with the powders and balls held in a stationary tank and agitated by rotating impellers. During milling the ingredients of the powder mixtures are reduced in size and brought into intimate contact by flattening and crushing the particles, welding them together, and repeating the process again and again. In effect, the powders are repeatedly torn or ripped apart (i.e., reduced in size) and recombined or built back up (i.e., fused or welded together) over an extended periods of time (normally 4 to 24 hours or even longer). Such techniques are often referred to as mechanical alloying. The resultant powders essentially consist of homogeneous and uniform distribution of the initial component within the powder particles U.S. Pat. Nos. 3,740,210, 3,816,080, 4,010,024, 4,101,713 4,300,947 4,705,560 4,722,751 and 4,749,545 provide representative examples of the use of high energy ball mills for producing homogeneous powders by mechanical alloying processes. High energy ball mills can also be used simply to reduce the particle size of a powder. Ultra fine particles having an average size of less than 5 microns may be produced using an attritor or a hammer mill over an extended time period.

U.S. Pat. No. 4,818,567 describes a process by which certain metallic coated particles are reported to be produced. The coated particles have relatively hard metal core material and a ductile and/or malleable metal coating material. In this method, the aspect ratio of a ductile and/or malleable metal is first reportedly increased to a high value (generally greater than about 50 to 1). The aspect ratio is defined as the ratio of the diameter of the particle to its thickness. The increased aspect ratio or essentially "flake" geometry can be achieved with relatively high speed vibratory, rotary, or attritor milling techniques. The resulting metal flakes are then reportedly applied to the relatively hard core material using a "mechanical smearing technique." The metal flakes and core material are reportedly milled in a low speed vibratory, rotary, or attritor mill "over an extended period of time until the ductile material has effectively coated the core metal particles through mechanical action." Coating materials include copper and copper alloys, aluminum and aluminum alloys, iron and iron alloys, nickel and nickel alloys, and lead and lead alloys. Core materials include iron and iron alloys, steel, stainless steel, and cobalt alloys. As noted, the core material must be sufficiently less deformable than the coating material so that the core material will hold its particle shape while the coating is applied.

Patent application Ser. No. 07/615,771 (Nov. 19, 1990) commonly assigned to the assignee of the present invention describes a method for preparing binderless thermal spray powders by mechanical agglomeration using a rotating drum with a treating member having an impact surface adjacent to the inner surface of the rotating drum. At least two powdered materials are placed in the rotating drum and are centrifugally forced against the continuously curved portion of the rotating drum, whereupon the powdered materials move between the impact surfaces of the treating member and the continuously curved portion of the drum. The forces of shear and compression acting on the powdered materials affect the mechanical agglomeration. The thermal spray powders produced by this method have the components dispersed uniformly throughout the particles. Experiments directed at preparing clad powders of the type of the present invention using the method of patent application Ser. No. 07//615,771 have not been successful for commercial applications.

Patent application Ser. No. 07/736,544 (Jul. 26, 1991) and commonly assigned to the assignee of the present invention describes a method for producing composite powders containing hexagonal boron nitride and aluminum or aluminum/silicon alloys where the components are comparable sized, finely-divided, and uniformly distributed. The composite powders may contain a binder or may be binderless. The binderless composites are generally prepared using the method described in patent application Ser. No. 07/615,771 discussed above.

Patent application Ser. No. 07/792,533 (Nov. 13, 1991) and commonly assigned to the assignee of the present invention describes a method for producing composite powders containing hexagonal boron nitride and metal alloys where the components are comparable sized, finely-divided, and uniformly distributed. The composite powders may contain a binder or may be binderless. The binderless composites are generally prepared using the method described in patent application Ser. No. 07/615,771 discussed above.

Although much effort has been directed towards preparing thermal spray powders, there still remains a need for binder-free agglomerates or composites, especially binder-free clad powders, which can be used as thermal spray powders. There still remains a need for a method of forming thermal spray powders, especially clad powders, which are binder-free and which have superior mechanical and chemical characteristics. And there remains a need for a simple and direct method of forming binderless clad powders in which the composition of the clad powder can be easily varied to provide a wide variety of composite coatings using thermal spray techniques. The present invention addresses these needs and others.

SUMMARY OF THE INVENTION

This invention relates to an improved method of forming binder-free clad powders and the binder-free clad powders so produced. These powders are especially useful for thermal spray applications. The binder-free clad powders of this invention are prepared by milling a core material powder and a coating material powder in a high energy ball milling apparatus for a relatively short time whereby the coating material coats the particles without significantly reducing the particle size of the core material powder. The starting core material powder is generally in the range of about 10 to 200 microns. The starting coating material powder is generally in the range of 0.1 to 20 microns or is a brittle material such that it will form particles in the range of about 0.1 to 20 microns during the first stage of the milling operation. Either the core material or the coating material must be deformable. Suitable core materials and coating materials include elemental metals and metal alloys. The coating material may also be a ceramic or a solid lubricant. Thus, a wide variety of clad powders can be produced by the method of this invention.

One important aspect of the present invention is that the time to which the core material powder and the coating material powder are subject to the action of the high energy ball mill is strictly limited and controlled. Normally, such high energy milling techniques are used to produce ultra fine powders or mechanical alloys. As detailed above, normally powders are subjected to extended periods (generally 4 to 48 hours or longer) of intense grinding and milling action in order to achieve a mechanical alloy or ultra fine particle size. It was not previously believed that clad powders could be prepared in such an apparatus using powdered (i.e., non-flake) starting materials. It was therefore surprising and unexpected to discover that clad powders could be easily and reproducibly prepared in such apparatus from powdered materials by significantly limiting the duration of the milling action. Generally, it has been found that milling times of less than about one hour in an attritor-type ball mill are satisfactory. Preferably, even shorter times are employed. In any event, the milling time must be sufficiently short such that the particle size of the material is not significantly reduced during milling. Thus, the resulting clad powder has essentially the same particle size as the starting core material powder.

It was also surprising and unexpected to discover that clad powders could be easily and reproducibly prepared by the method of the present invention with virtually any metal or alloy or ceramic or solid lubricant as the coating material. Surprisingly, the present method is essentially independent of the coating material so long as one of the components (i.e., the core material or the coating material) is deformable. Thus, many new clad powders that could not be prepared using prior art methods or could only be prepared with great difficulty or expense can now be prepared in relatively simple process and at relatively low cost.

One object of the present invention is to provide a method of forming a binderless clad powder, said method comprising the steps of:

(1) placing first and second materials in a drum of a high energy ball mill, wherein the first material has a particle size in the range of about 10 to 200 microns, wherein the second material has a particle size in the range of about 0.1 to 20 microns, wherein the particle size of the second material is significantly smaller than the particle size of the first material, and wherein at least one of the first and second materials is deformable within the high energy ball mill;

(2) processing said first and second materials in the high energy ball mill in the absence of any binder material for a time sufficient to form a binderless clad powder but where the particle size of the first material is essentially unchanged during the processing, wherein the clad powder consists essentially of the first material forming the core of the powder and the second material coating the surface of the core; and (3) collecting the binderless clad powder.

Another object of the present invention is to provide a method of forming a binderless clad powder, said method comprising the steps of:

(1) placing a non-brittle material and a brittle material in a drum of a high energy ball mill, wherein the non-brittle material has a particle size in the range of about 10 to 200 microns and is deformable within the high energy ball mill and wherein the brittle material has a particle size greater than 20 microns;

(2) processing the non-brittle material and the brittle material in the high energy ball mill in the absence of any binder material for a first time sufficient to reduce the particle size of the brittle material to about 0.1 to 20 microns without substantially changing the particle size of the non-brittle material, wherein the reduced particle size of the brittle material is significantly less than the particle size of the first material;

(3) continue processing the non-brittle material and the brittle material with reduced particle size for a second time sufficient to form a binderless clad powder but where the particle size of the non-brittle material is substantially unchanged during the processing, wherein the clad powder consists essentially of the non-brittle material forming the core of the powder and the brittle material with reduced particle size coating the surface of the core; and (4) collecting the binderless clad powder.

Still another object of the present invention is to provide a method of forming a thermal spray coating, said method comprising the steps of:

providing a binderless thermal spray powder consisting essentially of a binderless clad powder having a core of a first material with a coating of a second material on the surface of the core, where the clad powder is fabricated by processing powders of the first and second materials in a high energy ball mill; and thermal spraying the thermal spray powder on a target to form the thermal spray coating.

Still another object of the present invention is to provide a binderless clad powder having a core of a first material and a coating of a second material, where said binderless clad powder is prepared by a process comprising the steps of:

(1) placing the first and second materials in a drum of a high energy ball mill, wherein the first material has a particle size in the range of about 10 to 200 microns, wherein the second material has a particle size in the range of about 0.1 to 20 microns, wherein the particle size of the second material is significantly smaller than the particle size of the first material, and wherein at least one of the first and second materials is deformable within the high energy ball mill;

(2) processing said first and second materials in the high energy ball mill in the absence of any binder material for a time sufficient to form a binderless clad powder but where the particle size of the first material is substantially unchanged during the processing, wherein the clad powder consists essentially of the first material forming the core of the powder and the second material coating the surface of the core; and (3) collecting the binderless clad powder.

These and other objects, advantages, and meritorious features of the invention will now be more fully explained in connection with the following drawings.

BRIEF DESCRIPTION OF THE DRAWINGS

FIGS. 4 and 5 show aluminum coated nickel particles (as described in Example 1) at different magnifications. FIGS. 6 and 7 show alumina coated cobalt alloy particles (as described in Example 2).

DETAILED DESCRIPTION OF THE PREFERRED EMBODIMENTS OF THE INVENTION

The present invention provides a general method for forming thermal spray powders—more specifically, binderless clad thermal spray powders—by high energy ball milling. This method allows for such binderless clad powders to be prepared in a relatively simple, inexpensive, and reproducible manner. This method also allows for a variety of binderless clad powders to be prepared with widely varying core constituents and coating constituents. Generally the core materials include elemental metals and metal alloys while the coating materials include elemental metals, metal alloys, ceramics, and solid lubricants. Thus, clad powders tailored for specific applications and properties can be prepared in a straight forward manner.

Figure 1:
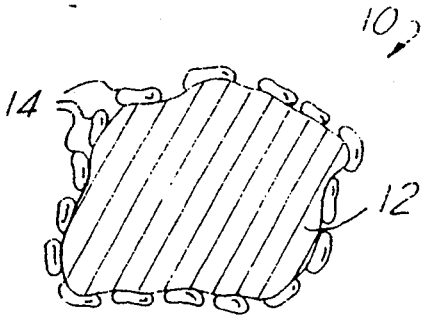
FIG. 1 illustrates in cross section a clad powder produced by the method of the present invention with a relatively harder core material and a relatively softer coating material.
Figure 2:
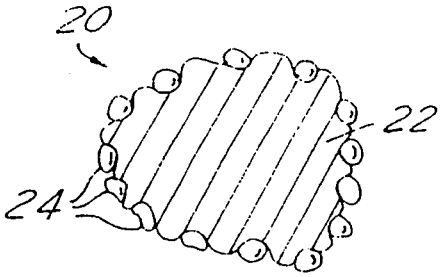
FIG. 2 illustrates in cross section a clad powder produced by the method of the present invention with a relatively softer core material and a relatively harder coating material.

The binderless clad powders of the present invention consist of core material and coating material wherein the coating material is deposited on the outer surface of the core particles. At least one of these materials (i.e., the core material or the coating material) must be deformable within the environment of the high energy ball mill. FIG. 1 illustrates a clad particle 10 formed where the core particle 12 is less deformable that the coating material 14. In this instance, the coating material 14 tends to be smeared or flattened out on the surface of the core particle 12 and the core particle 12 is essentially not deformed. FIG. 2 illustrates a clad particle 20 where the core particle 22 is more deformable than the coating material 24. In this instance, the coating material 24 tends to be embedded into the surface of the core particle 22. As one skilled in the art will realize, clad particles may be formed which are intermediate to those illustrated in FIGS. 1 and 2.

Clad particles may be also formed in which more or less of the surface area of the core particles 12 and 22 are covered with coating material 14 and 24 than as illustrated in FIG. 1 and 2. The surface coverage can be varied by simply varying the relative ratios of the core material powder and the coating material powder. Generally about 20 to 100 percent of the surface of the core particle, on average, is coated with the coating material. Preferably about 50 to 100 percent of the outer surface of the core particles are covered with the coating material. With 100 percent coverage, the core particles are essentially encased by the coating material. Of course, the preferred coverage can vary with the intended application.

In one embodiment of the present invention, a first or core material powder and a second or coating material powder are treated in a high energy ball mill, preferably an attritor-type mill, for a time sufficiently long to coat the second material on the first or core material powder but sufficiently short to avoid a significant change or reduction in the particle size of the first or core material powder. Either the first material or the second material should be deformable in the high energy ball mill apparatus. The particle size of the core material is generally in the range of about 10 to 200 microns, preferably in the range of about 10 to 150 microns, and most preferably in the range of about 10 to 100 microns. The particle size of the coating material is generally in the range of about 0.1 to 20 microns, preferably about 1 to 10 microns, and most preferably about 1 to 4 microns. Independent of these ranges, the particle size of the coating material should be significantly smaller than the particle size of the core material. By "significantly smaller" it is meant that the ratio of the average particle size of the core material to the average particle size of the coating material is greater than about 5. Preferably, this ratio is greater than about 10 and most preferably greater than about 20. As one skilled in the art will realize, if the particle size of the core particle is at the lower end of the 10 to 200 micron range (i.e., about 10 microns) the particle size of the coating material must also be near the lower end of its 0.1 to 20 range (i.e., about 2 micron or less).

In another embodiment of the present invention, a first or non-brittle core material powder and a second or brittle coating material are treated in a high energy ball mill preferably an attritor-type mill, for a time sufficiently long to reduce the particle size of the brittle material to less than about 20 microns and then coat the resulting reduced particle size second material on the first or brittle core material powder but sufficiently short to avoid a significant change or reduction in the particle size of the first or non brittle core material powder. The first material should be deformable in the high energy ball mill apparatus. The particle size of the non-brittle core material is generally in the range of about 10 to 200 microns, preferably in the range of about 10 to 150 microns, and most preferably in the range of about 10 to 100 microns. The initial particle size of the brittle coating material is generally greater than about 20 microns. Because of its brittle nature, the brittle coating material is quickly broken down in the high energy ball mill to a powder having a reduced particle size in the range of about 0.1 to 20 microns. preferably about 1 to 10 microns, and most preferably about 1 to 4 microns. Independent of these ranges, the reduced particle size of the coating material should be significantly smaller than the particle size of the core material. When using a brittle coating material, for example a brittle oxide, the brittle coating material and the non-brittle core material powder are treated in the high energy ball mill for a first time sufficient to reduce the particle size of the brittle material to the desired reduced particle size ranges indicated a above. The reduced size brittle coating material and the non-brittle core material powder (whose particle size should be essentially unchanged) are then further treated in the high energy ball mill for a second time sufficiently long to coat the coating material on the non-brittle core material powder but sufficiently short to avoid a significant change or reduction in the particle size of the non-brittle core material powder. For convenience both here and in the claims, the reduction of the brittle coating material and the actual cladding process have been discussed as two separate processes. But, as one skilled in the art will appreciate, the two process can and likely will overlap. For example, while the brittle material is being broken down in the initial stages of the milling process the coating process can also be proceeding with brittle material that has already been reduced in particle size. Preferred brittle materials suitable for use as coating materials in the present invention include brittle ceramic materials. Especially preferred brittle ceramic materials include brittle oxides, brittle carbides, brittle borides, brittle silicides, brittle nitrides, brittle silicates, and combinations thereof.

This invention is not limited to binderless clad powders prepared from a single core material and/or a single coating material, although in many instances such clad powders may be preferred. Multi-component clad powders can also be prepared. For example, two or more core material powders can be processed with a single coating material to form clad powders with different core particles. Or two or more coating materials can be processed with a single core material powder to form clad particles with mixed coatings. Or clad powders with two or more core particles and two or more coating materials can also be prepared. Such multi-component powders can be prepared in the same manner as described for the single core material and single coating material powders. Thus, throughout this specification and in the claims, reference to first or core material is to include one or mixtures of such core materials and reference to a second or coating material is to include one or mixtures of such coating materials.

As noted above, the surface coverage of the coating material on the core material can be varied by simply varying the relative ratios of the core material powder and the coating material powder. But as one skilled in the art will realize, surface coverage will also depend to some extent on other factors such as the particle sizes, apparent densities, and deformability of the two powders. Generally, however, it is preferred that the weight ratio of the core material to the cladding material be in the range of about 1 to 50. In some applications, weight ratios above or below this range may be acceptable and even preferred. As also noted above, generally about 20 to 100 percent of the surface of the core particle, on the average, is coated with the coating material. Surface coverage below this range may be acceptable and even preferred for some applications.

The coating thickness will preferably be less than about 15 microns and more preferably less than about 8 microns. For some applications, coating thicknesses less than or greater than these ranges may be appropriate or even preferred. As one skilled in the art will realize, coating coverage, coating thickness, and the ratio of core material to coating material are related parameters.

The cladding process of the present invention is carried out in a high energy ball mill by simply charging the drum of the mill with the appropriate powders and then processing the powders within the mill. Suitable high energy ball mills include attritor mills, ball mills, and the like. Preferably, the drum of the high energy ball mill is stationary and contains rotating impellers which impact the balls contained therein, thereby setting the balls into essentially random motion within the drum. Through the random motion of the balls contained within the drum, the first and second materials therein are agitated with sufficient force to form the clad powder of this invention. The preferred material treatment apparatus for use in the present invention is an attritor mill. One such attritor mill is described in U.S. Pat. No. 3,591,362, the entire disclosure of which, including the drawings, is incorporated herein by reference. Suitable attritor mills are available commercially. Attritors from Union Process of Akron, Ohio, have been found to be particularly satisfactory.

Figure 3:
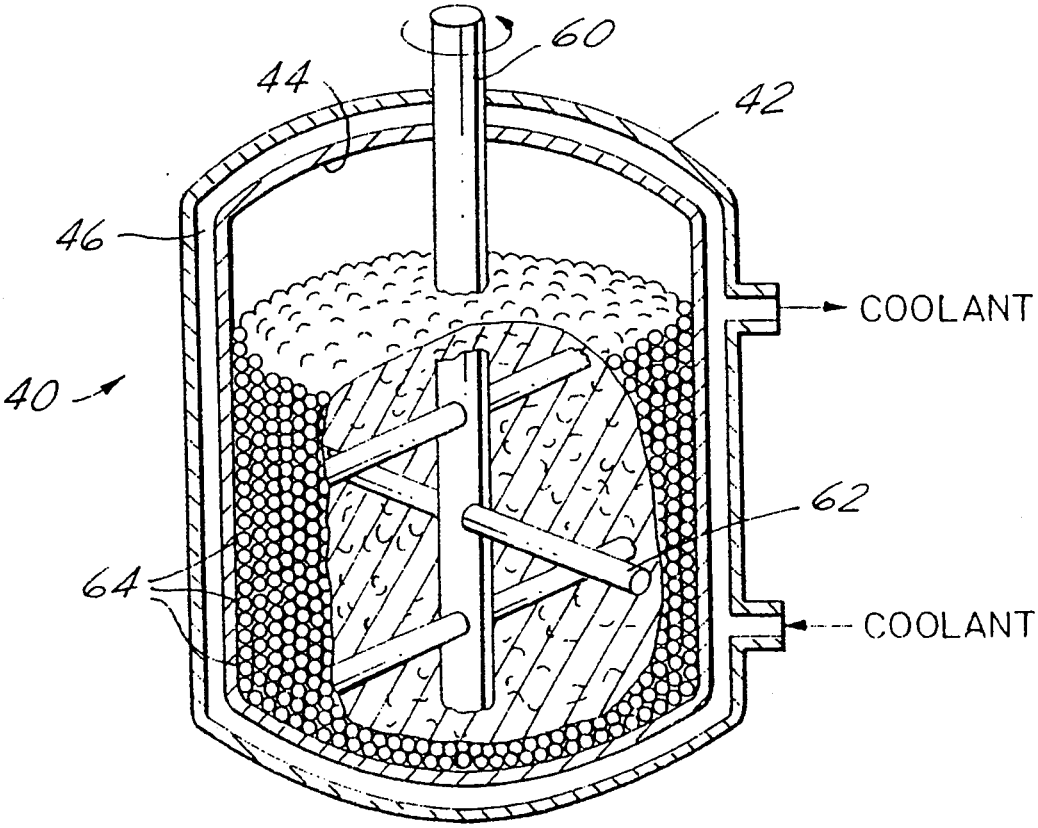
FIG. 3 illustrates an example of a high energy ball mill of the attritor mill type which can be used to prepare the clad powders of the present invention.

An illustrative attritor mill is shown in FIG. 3. The drum 40 of the attritor mill illustrated has an outer shell 42 and an inner shell 44. Between the shells 42 and 44 is a passage 46 through which coolant or other heat transfer fluids can be passed in order to remove excess heat generated during operation or otherwise control the temperature. Inside drum 40 are located the actual grinding balls 64. The appropriate first core-forming material and second coating material are charged into the drum and occupy the same space within the inner shell 44 as the balls 64. The rotating shaft 60 has multiple arms or impellers 62 which extend into and rotate through the mass of the balls and the added first and second materials. The rotation of the impellers 62 through the balls 64 sets the balls into essentially random motion. This random motion of the balls impacting each other (with powder from the first and second materials at the contact points) results in the formation of the clad powder of this invention.

The resulting clad powder essentially has essentially the same particle size as the core material since the core material's particle size is essentially unchanged in the high energy ball mill. By "essentially unchanged" it is meant that the average particle size of the core powder is reduced by no more than about 40 percent, preferably no more than about 20 percent, and most preferably no more than about 10 percent in the high energy ball mill processing. For thermal spray powders, a particle size in the range of about 10 to 150 microns generally preferred. If the core material, and thus the resulting clad powder, has a significant fraction outside of this range it is generally preferred that the clad powder be classified using conventional classification techniques to obtain particles within the desired particle size range. Or more preferably, the particle, size, of the core material could be selected to avoid or minimize the need for classification after formation of the clad powder.

As those skilled in the art will realize, the energy input and other processing parameters of the high energy ball mill (i.e., the attritor of FIG. 3), and thus the process of this invention, can be controlled. Such controllable parameters include speed of rotation of the impellers through the balls, the number, size, and compositions of the milling balls, atmosphere within the drum, ratio of the weight of the powders to be milled to the weight of the balls, and milling times. Many of these parameters are, of course, interrelated. For example, increasing the rotational speed of the impellers through the ball/powder charge should allow for even shorter processing times.

Generally, processing times of less than about one hour are preferred. Such short processing times prevent significant reduction in the particle size of the core material powder. Generally, even shorter processing times (i.e., less than 30 minutes) are preferred so long as sufficient cladding occurs. In order to prevent oxidation of the materials, is generally preferred that the processing with the high energy ball mill be under an inert atmosphere (e.g., argon or nitrogen). In some instances, however, it may be desirable to promote oxidation and so an oxygen-containing atmosphere can be used.

The impellers 62 shown in FIG. 3 are in the form of arms attached to the rotating shaft 60. Of course, other types of impellers can be used. For example, paddles or other shaped arms could be used n place of the straight arms shown in FIG. 3.

The size and composition of the milling balls 64 can also vary widely. For example, suitable milling balls include metal balls, ceramic balls, carbide balls, and the like. And the milling balls generally vary from about $\frac{1}{8}$ to $\frac{3}{4}$ inches in diameter depending on the size of the drum and the desired operating conditions. The selection of the size, number, and compositions of the milling balls is within the skill of the art.

A wide variety of materials may be utilized in forming the novel clad powders of the present invention. Generally the core materials include elemental metals, metal alloys, plastics, carbides oxides, borides, silicides, and nitrides which, when subjected to the action of the high energy ball mill during the formation of the clad powders, will not significantly decrease in particle size. Generally the coating materials include elemental metals, metal alloys, ceramics, carbides, oxides, nitrides, silicides, borides, carbon, transition elements, inorganic compounds, and solid lubricants. Examples of suitable core materials include: metals such as nickel and copper; alloys such as nichrome, monel, and bronze; plastics such as polyester and polyimide; carbides such as tungsten carbide and silicon carbide; oxides such as stabilized zirconia; borides such as titanium diboride; silicides such as molybdenum silicide; and nitrides such as boron nitride. Examples of suitable coating materials include: metals such as aluminum, iron, molybdenum, nickel, and cobalt; metal alloys such as bronze, monel, and cobalt alloys; ceramics such as aluminum oxide; carbides such as titanium carbide; nitrides such as boron nitride; silicides such as moly-di-silicide; borides such as titanium diboride; transition elements such as boron; inorganic compounds such as calcium difluoride; and solid lubricants such as hexagonal boron nitride. Neither of these lists of suitable core or coating materials is intended to be all inclusive.

Thus, clad powders tailored for specific applications and properties can be prepared in a straight forward manner. For example, the first or core material may comprise one or more metals selected from the group consisting of Fe, Ni, Co, Cu, Cr, Al, Ti, and their alloys. A preferred second or coating material useful in the present invention when the preferred first material is one or more of the aforementioned metals is a metal selected from the group consisting of Al, Ti, Ta, Mo, Si, Co, Ni, Fe, and their alloys. It has been found that a combination of these first and second materials generate a product which, when thermally sprayed, exhibits exceptional adhesion to metal substrates. The resulting composite particles are from about 70 to about 99 percent by weight first material and from about 1 to about 30 percent by weight second material. And more preferably, the resulting composite particles are from about 80 to about 99 percent by weight first material and from about 1 to about 20 percent by weight second material.

Another preferred combination of first and second materials in the present invention is the use of a metal or alloy as the first or core material selected from the group consisting of Fe, Ni, Co, Cu, Cr, Al, Ti and their alloys, and a second or coating material which is a ceramic. Preferred ceramics for use in their present invention are selected from the group consisting of oxides, carbides, borides, boron nitride, silicides, silicates, phosphates, spinels, titanates, perovskites, forms of carbon and combinations thereof. The resulting composite particles are from about 70 to about 99 percent by weight first material and from about 1 to about 30 percent by weight second material. And more preferably, the resulting composite particles are from about 80 to about 99 percent by weight first material and from about 1 to about 20 percent by weight second material.

In another embodiment, the preferred materials for use in the present invention are a first or core material, comprising one or more metals, most preferably Fe, Ni, Co, Cu, Al, Ti, and their alloys, a second or coating material comprising one or more relatively soft ceramics, such as fully or partially stabilized zirconia, phosphates of calcium, machinable ceramics, titanates, perovskites, and the like, and solid lubricants such as boron nitride, moly-di-silicide, sulfides, fluorides, and the like. Preferred combinations include aluminum alloys, aluminum-silicon alloys, Ni—Cr—Al—Y alloys, or titanium alloys as the first or core material and boron nitride or hydroxyapatite as the second or coating material.

The method of the present system can be operated in a batch or semi-continuous system. The amount of material processed in a batch system will vary widely. It is believed, however, that up to about 15 gallons of material can be processed in a single batch depending on the drum dimensions. Processing times are generally less than one hour and preferably between about 5 and 30 minutes. The processing time should be such that the particle size of the core material is not significantly reduced or changed. Processing temperature is normally close to the maximum tolerated by the powders and the materials and seals of the apparatus, but no higher than 250° C. for the standard apparatus. Specially constructed apparatus may be able to tolerate higher temperatures. For thermal spray applications the finished clad particles may be classified to provide a powder in which the average particle size is from about 10 to about 150 microns, where the particles range from 0.5 to about 177 microns in size. Such thermal spray fractions more preferably have an average particle size in the range of about 10 to 100 microns.

In still another embodiment of the present invention, a method of forming a coating is provided in which the composite particles formed in accordance with the present invention are thermally sprayed. More specifically, clad particles manufactured in accordance with the present invention are thermally sprayed utilizing a suitable thermal spray gun. One preferred thermal spray apparatus for use in the present invention is that disclosed in U.S. Pat. No. 5,019,686, which has been assigned to the assignee of the present invention, and the entire disclosure of which is incorporated herein by reference. Another preferred thermal spray apparatus for use in this invention is that disclosed in U.S. Pat. No. 5,135,166, which is hereby incorporated by reference.

Thermal spraying may also be carried out using other suitable oxyfuel or plasma spray guns. Thermal spraying may be carried out in vacuum, or under an inert atmosphere of, for example, nitrogen or under atmospheric conditions. The feed rate and other parameters of the process may vary depending upon the spray equipment and the material being sprayed. The binderless clad powders of this invention may also be suitable for application by non-thermal spray methods (e.g., compaction and sintering, hot isostatic pressing, etc.).

The following examples are intended to illustrate the invention and not to limit the invention.

EXAMPLE 1

Figure 4:
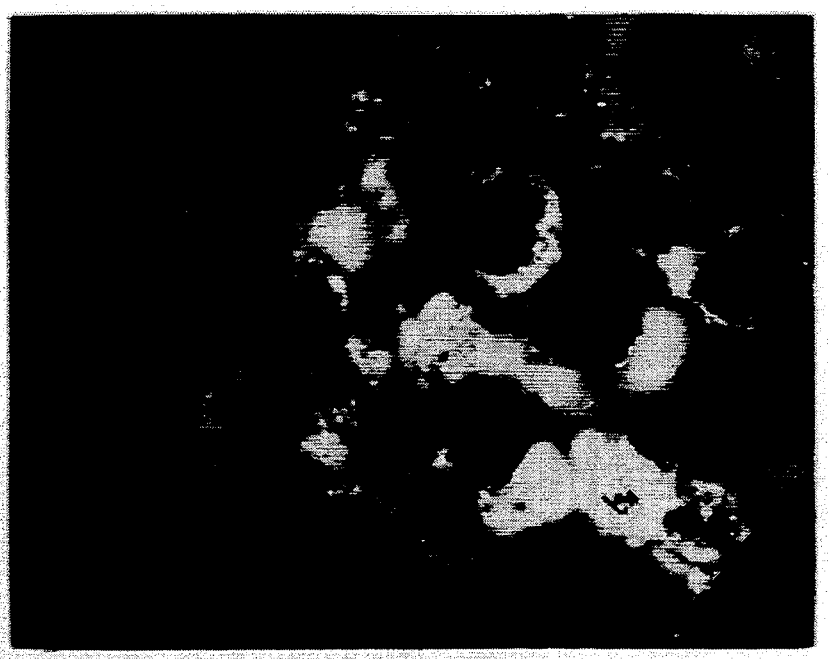
FIGS. 4, 5, 6, and 7 are photomicrographs of illustrative clad powders produced by the method of the present invention.
Figure 5:
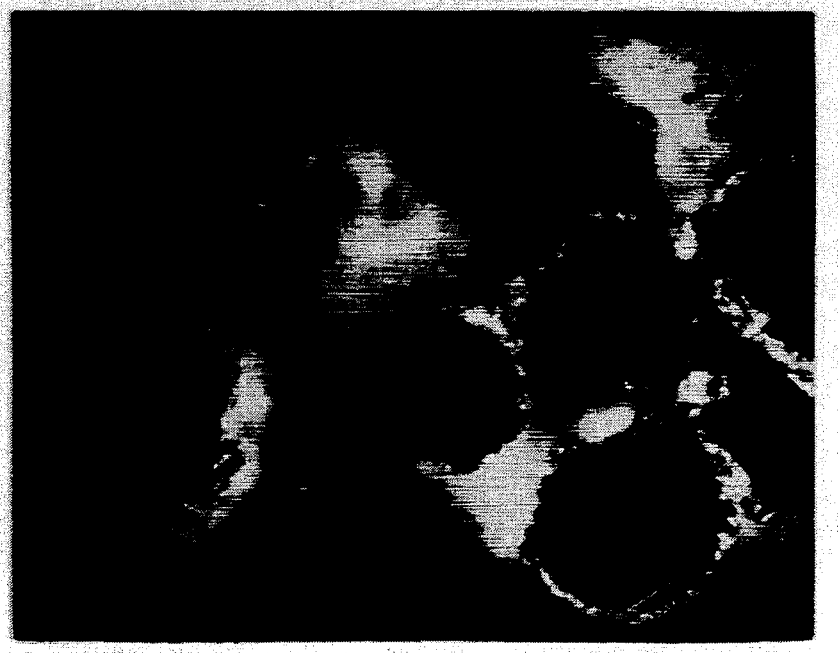

This example illustrates the preparation of an aluminum coated nickel powder suitable for use as a thermal spray powder. Nickel powder (about 2368 grams; −140 to +325 mesh) and aluminum powder (about 263 grams; 5 microns) were milled together for 20 minutes under an inert atmosphere in an attritor mill from Union Process. Inc., Akron, Ohio (Model 1-S). This attritor mill has a 1.5 gallon stainless steel, double-walled tank with tool steel agitator arms. Approximately 40 pounds of ¼ inch chrome steel balls were used as the milling media. After all components were loaded, the tank was flushed with argon gas and the agitator shaft was set to rotate at 300 ppm. During milling the chamber was cooled by flowing water around the inner tank. After milling for 20 minutes, the resulting powder was discharged and screened at −140 to +325 mesh. An excellent composite powder consisting of aluminum coated nickel was obtained. Photomicrographs of the resultant composite powder are shown in FIGS. 4 and 5. FIG. 4 is a polarized light micrograph of a cross section of the coated powder at 100× magnification. The white ring-like areas indicate aluminum coating material and the dark areas indicate nickel core material. The larger, more diffuse white areas are coated particles that were embedded in the mount below the plane of view and show the surface cladding. FIG. 5 is the same as FIG. 4 except the magnification was increased to 200×. Excellent coatings were obtained by plasma spraying this composite powder under both atmospheric and vacuum conditions.

EXAMPLE 2

Figure 6:
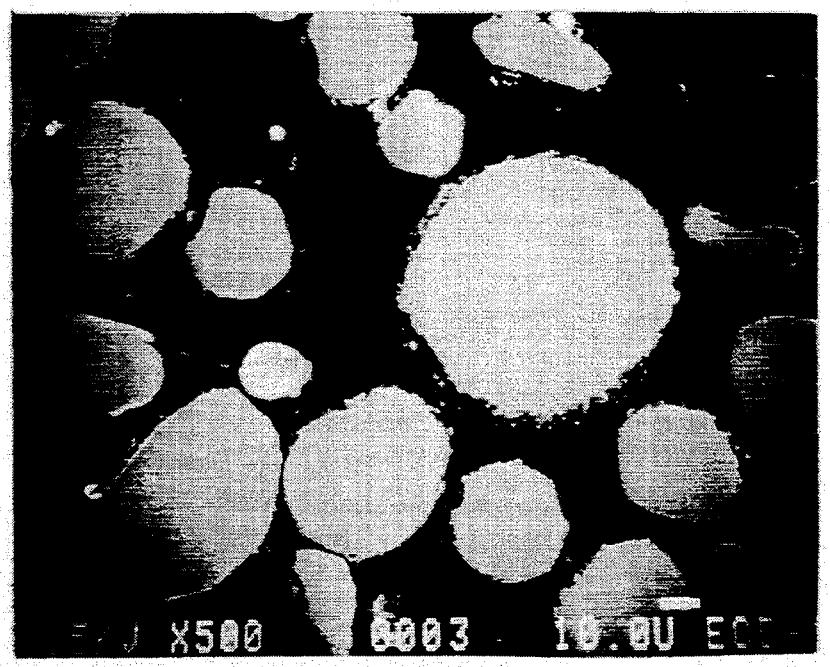
Figure 7:
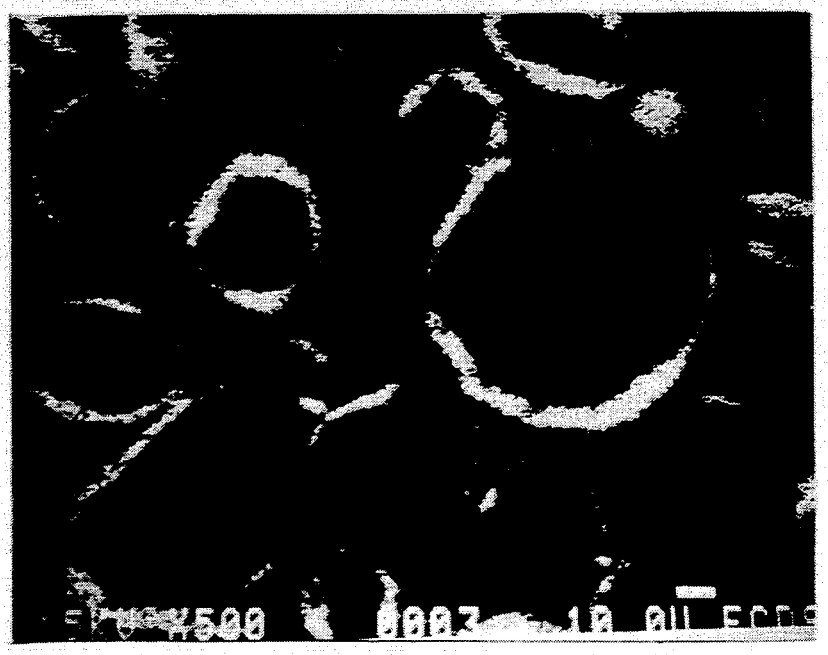

This example illustrates the preparation of an aluminum oxide coated cobalt based alloy. Using the same equipment and procedure as in Example 1, a cobalt based alloy (Co-30Ni-20Cr-8Al-0.5Y; 2264 grams; −325 mesh to +10 microns) and calcined alumina (251 grams; about 1 micron average) were milled for 30 minutes under an argon atmosphere. The resultant powder was screened at −325 mesh. An excellent alumina coated cobalt alloy powder was produced which, when thermally sprayed, produced outstanding coatings. Photomicrographs of the resultant composite powder are shown in FIGS. 6 and 7. FIG. 6 is a cross-sectional view taken with a scanning electron microscope at a magnification of 500× showing the core and coating layers. FIG. 7 shows the same particles of FIG. 6 using an EDAX attachment for alumina mapping. The white areas of FIG. 7 represents alumina and clearly shows the coating layers.

EXAMPLE 3

This example illustrates the preparation of a lanthanum oxide coated cobalt based alloy. This example also illustrates the use of a coarse, brittle material as the coating component. Using the same equipment and procedure as in Example 1, a cobalt based alloy (Co-30Ni-20Cr-8Al-0.5Y; 2264 grams; −325 mesh to +10 microns) and coarse lanthanum oxide (251 grams; about −80 mesh) were milled for 30 minutes under an inert atmosphere. During milling, the brittle lanthanum oxide was significantly reduced in particle size and effectively coated the cobalt alloy particles. The resultant powder was screened at −325 mesh. An excellent lanthanum oxide coated cobalt alloy powder was produced which, when thermally sprayed, produced outstanding coatings.

EXAMPLE 4

This example illustrates the preparation of a boron nitride coated aluminum-silicon alloy. Using the same equipment and procedure as in Example 1 (except that the agitator shaft was rotated at about 200 rpm), an aluminum-silicon alloy (12 percent silicon; 1000 grams; −200 to +325 mesh) and hexagonal boron nitride (200 grams; 7 microns average) were milled for 20 minutes under an argon atmosphere. The resultant powder was screened at −325 to −140 mesh. An excellent boron nitride coated aluminum-silicon alloy composite was obtained. When thermally sprayed, this composite yielded excellent coatings.

Thus, it is apparent that there has been provided in accordance with the invention a method that fully satisfies the objects, aims, and advantages set forth above. While the invention has been described in connection with specific embodiments thereof it is evident that many alternatives, modifications, and variations will be apparent to those skilled in the art in light of the foregoing description. Accordingly, it is intended to embrace all such alternatives, modifications and variations that fall within the spirit and broad scope of the appended claims.

What is claimed is:

1. A method of forming a composite binderless clad powder, said method comprising the steps of:

(1) placing first and second materials in a drum of an attritor mill with a plurality of grinding balls, said attritor mill having a rotating shaft extending into said drum and said shaft having a plurality of impellers which set said grinding balls in motion, wherein the first material has a particle size in the range of about 10 to 200 microns, wherein the second material has a particle size in the range of about 0.1 to 20 microns, wherein the particle size of the second material is significantly smaller than the particle size of the first material, and wherein said first material is a deformable metal selected from the group consisting of elemental metals and alloys thereof and said second material is a brittle ceramic;

(2) processing said first and second materials in the attritor mill in the absence of any binder material for a time sufficient to form a binderless clad powder but where the particle size of the first material is substantially unchanged during the processing, wherein the clad powder consists essentially of the first material forming the core of the powder and the second material coating the surface of the core;

(3) collecting and removing the binderless clad powder from said drum.

2. A method of forming a binderless clad powder, said method comprising the step of:

(1) placing a metal or metal alloy and a brittle ceramic in a drum of a high energy ball mill, wherein the metal or metal alloy has a particle size in the range of about 10 to 200 microns and is deformable within the high energy ball mill and wherein the brittle ceramic has a particle size greater than 20 microns;

(2) processing the metal or metal alloy and the brittle ceramic in the high energy ball mill in the absence of any binder material for a first time sufficient to reduce the particle size of the brittle ceramic to about 0.1 to 20 microns without substantially changing the particle size of the metal or metal alloy, wherein the reduced particle size of the brittle ceramic is significantly less than the particle size of the metal or metal alloy;

(3) continue processing the metal or metal alloy and the brittle ceramic with reduced particle size for a second time sufficient to form a binderless clad powder but where the particle size of the metal or metal alloy is substantially unchanged during the processing, wherein the clad powder consists essentially of the metal or metal alloy forming the core of the powder and the brittle ceramic with reduced particle size coating the surface of the core; and (4) collecting the binderless clad powder.

3. The method of claim 2, wherein the combined processing time in steps (2) and (3) is less than about one hour.

4. The method of claim 3, wherein the drum of the high energy ball mill is stationary and contains rotating impellers which impact balls contained therein thereby setting the balls into essentially random motion within the drum, wherein the metal or metal alloy and the brittle ceramic therein are agitated with sufficient force to form the clad powder.

5. The method of claim 3, wherein the high energy ball mill is an attritor mill.

6. The method of claim 3, wherein the binderless clad powder is classified to form a thermal spray powder fraction.

7. The method of claim 6, wherein the thermal spray powder fraction has an average particle size from about 10 to 150 microns.

8. The method of claim 3, wherein the metal or metal alloy has an average particle size in the range of about 10 to 100 microns.

9. The method of claim 3, wherein the brittle ceramic has a reduced particle size in the range of about 1 to 10 microns.

10. The method of claim 2, wherein the metal or metal alloy is selected from the group consisting of Fe, Ni, Co, Cu, Cr, Al, Ti, and alloys thereof.

11. The method of claim 2, wherein said brittle ceramic is selected from the group consisting of brittle oxides, brittle carbides, brittle borides, brittle silicides, brittle nitrides, brittle silicates, and combinations thereof.

* * * * *